US006953016B2

(12) United States Patent
Karbstein et al.

(10) Patent No.: US 6,953,016 B2
(45) Date of Patent: Oct. 11, 2005

(54) TAPPET IN A VALVE TRAIN OF AN INTERNAL COMBUSTION ENGINE

(75) Inventors: Henning Karbstein, Strullendorf (DE); Mario Kuhl, Herzogenaurach (DE); Jason Morehead, Northville, MI (US)

(73) Assignee: Ina-Schaeffler KG (DE)

( * ) Notice: Subject to any disclaimer, the term of this patent is extended or adjusted under 35 U.S.C. 154(b) by 0 days.

(21) Appl. No.: 10/763,759

(22) Filed: Jan. 23, 2004

(65) Prior Publication Data

US 2004/0177822 A1 Sep. 16, 2004

Related U.S. Application Data

(60) Provisional application No. 60/445,181, filed on Feb. 5, 2003.

(51) Int. Cl.[7] ..... F01L 1/14

(52) U.S. Cl. ..... 123/90.48; 123/90.5; 123/90.52; 123/90.55; 74/569

(58) Field of Search ..... 123/90.48–90.5, 123/90.52, 90.55; 74/569

(56) References Cited

U.S. PATENT DOCUMENTS

| | | | | |
|---|---|---|---|---|
| 2,179,354 A | | 11/1939 | Scott | |
| 5,188,068 A | | 2/1993 | Gaterman et al. | |
| 5,921,210 A | * | 7/1999 | Regueiro | 123/90.22 |
| 2003/0145818 A1 | * | 8/2003 | Vene | 123/90.48 |

FOREIGN PATENT DOCUMENTS

| | | |
|---|---|---|
| DE | 302727 | 10/1972 |
| DE | 25 40 061 | 5/1976 |
| DE | 41 15 668 A1 | 11/1992 |
| DE | 695 11 627 T2 | 5/1994 |

* cited by examiner

*Primary Examiner*—Thomas Denion
*Assistant Examiner*—Kyle M. Riddle
(74) *Attorney, Agent, or Firm*—Charles A. Muserlian

(57) ABSTRACT

The invention proposes a tappet (1) in a valve train of an internal combustion engine having a bottom camshaft for acting on a tappet push rod, said tappet being arranged with a housing (2) for axial displacement, but secured against rotation, in a guide bore (3) of the internal combustion engine (3*a*) or of a component connected to the internal combustion engine, said housing (2) comprising on one front end (4), two cheek-like extensions (5) that are situated diametrically opposite each other and are connected by an axle (6) on which a rotary roller (7) extends for making direct contact with a cam, said front end (4) comprising a transverse region (8) that connects the extensions (5) axially inside and has a cylindrical shape in a length direction of the roller (7), and said guide bore (3) being intersected by two passages (12, 13) for routing hydraulic medium to the tappet (1), wherein a radius center point (M) of the transverse region (8) of the one front end (4) is situated with a lateral offset to a longitudinal axis of the tappet (1), so that one side (14) of a periphery of the housing (2) between the extensions (5) is distinctly longer than an opposite side (15), and the two passages (12, 13) are led to the housing (2) at least approximately on the longer one side (14) of the periphery.

5 Claims, 1 Drawing Sheet

TAPPET IN A VALVE TRAIN OF AN INTERNAL COMBUSTION ENGINE

This application claims the benefit of Provisional Application No. 60/445,181, filed Feb. 5, 2003.

FIELD OF THE INVENTION

The invention concerns a tappet in a valve train of an internal combustion engine having a bottom camshaft for acting on a tappet push rod, said tappet being arranged with a housing for axial displacement, but secured against rotation, in a guide bore of the internal combustion engine or of a component connected to the internal combustion engine, said housing comprising on one front end, two cheek-like extensions that are situated diametrically opposite each other and are connected by an axle on which a rotary roller extends for making direct contact with a cam, said front end comprising a transverse region that connects the extensions axially inside and has a cylindrical shape in a length direction of the roller, an inner element being arranged in the housing for axial displacement relative to the housing, a head of the inner element forming a support for the tappet push rod in a region of a further front end of the housing, and said guide bore being intersected by one passage or by two passages for routing hydraulic medium to the tappet.

BACKGROUND OF THE INVENTION

A tappet of the pre-cited type is disclosed in the generic document DE 100 02 287 A1. This tappet likewise comprises on one of its front ends, two cheek-like extensions situated diametrically opposite each other. A roller for making contact with a cam is mounted for rotation on an axle that extends between the extensions. These extensions are left over, so to speak as "residual parts" after a milling operation (disk milling) for example, and thus form axial extensions of the housing.

In addition, a person skilled in the art will see that an inner element is installed in the pre-cited tappet for axial movement relative to its housing and comprises a hydraulic lash adjuster, and that a piston-like coupling means is arranged in the inner element for an optional coupling of the inner element to the housing. The lash adjuster and the coupling means are pressurized with hydraulic medium through separate passages leading to a guide bore (not illustrated) of the roller tappet. As a rule, these passages are situated precisely on the axially shorter side of the periphery of the housing, that is to say, on the side that is offset at 90° to the cheek-like extensions.

A particular drawback of this design is that, precisely in this peripheral region, only a short axial sealing length is available. This means, in other words, that due to the short axial leak gap formed between the outer peripheral surface of the housing and the guide bore, unnecessarily high hydraulic medium losses are to be expected. In the worst case, it is also possible for a lower front end of the tappet to penetrate into edge regions of the lower passage.

It is true that closed "spaces" for the roller on the tappet are known from prior art documents, for instance, from DE 199 15 531 A. However, this closed design has a number of inherent drawbacks. On the one hand, the total mass of the tappet is unnecessarily increased and this has a detrimental effect on the oscillating mass of the valve train. On the other hand, it is only with considerable difficulty that the closed roller pocket can be fabricated, and as can be seen from the cited prior art, it has to be connected to the rest of the tappet body by an appropriate, complicated and cost-intensive connecting or joining method. The fact that an adequate lateral freedom of movement of the roller relative to the wall of its pocket is still required restricts the possibilities of its designing and arrangement.

OBJECTS OF THE INVENTION

It is an object of the invention to provide a tappet of the pre-cited type in which the mentioned drawbacks are eliminated.

This and other objects and advantages of the invention will become obvious from the following detailed description.

SUMMARY OF THE INVENTION

The invention achieves the above objects by the fact that a radius center point of the transverse region of the one front end is situated with a lateral offset to a longitudinal axis of the tappet, one side of a periphery of the housing between the extensions is distinctly longer than an opposite side, and the one passage, or both passages is/are led to the housing at least approximately on the longer one side of the periphery.

Alternatively, the invention also achieves the above objects by the fact that a radius center point of the transverse region of the one front end is situated with a lateral offset to a longitudinal axis of the tappet so that one side of a periphery of the housing between the extensions is distinctly longer than an opposite side, and the first passage is led to the housing at least approximately on the longer one side of the periphery, while the second passage is led to the housing at least approximately on the shorter, opposite side of the periphery, said second passage being led to the housing at a larger axial distance from the one front end of the housing than the first passage.

Thus, the aforesaid drawbacks are eliminated with simple measures. A lengthened housing is obtained precisely on that side of the housing on which the at least one passage (or both passages) is led to the housing, so that an adequate sealing length is available. In this way, the aforesaid hydraulic medium losses are substantially eliminated. If the passages open into two diametrically opposing hydraulic medium bores, the axially lower bore can be arranged on the "lengthened" housing. It is clear that the housing with its front end extension is installed so as to extend with its extension only approximately on the side on which the passages are arranged (except in the case of diametrically opposing passages).

The invention also applies to further types of cam followers preferentially used in internal combustion engines.

If only one passage leads to the tappet, it can be used exclusively, for example, for actuating a hydraulic lash adjuster installed in the tappet or exclusively for actuating a coupling means arranged in the tappet for an optional coupling of the its inner element to the housing. However, the one passage can also serve at the same time for routing hydraulic medium to both mentioned devices.

If two passages lead to the guide bores, they can be arranged axially above each other, in which case one passage leads to the hydraulic element and the other to the coupling means. The same applies to the diametrically opposing passages. In general, if two passages are provided, the hydraulic lash adjuster of the tappet does not have to be integrated in the tappet and, instead, one of the passages can be used for displacing the coupling means in their coupling direction and the other for displacing the coupling means in their uncoupling direction.

The eccentric transverse region between the extensions in the length direction of the roller can be made, for instance, by a machining method such as disk milling. The radius center point of the disk milling cutter is positioned with a lateral offset from the longitudinal axis of the tappet, so that the "lowest" point of the transverse region (as seen from the camshaft) is in no case intersected by the longitudinal axis of the tappet. If necessary, the housing region situated on the lengthened side of the housing may be only slightly recessed or not at all.

Although it is proposed to form the front end extensions of the housing, so to speak, integrally on the housing, so that their outer peripheral surface is then naturally aligned to the outer peripheral surface of the rest of the housing, it is also conceivable to make the extensions as separate parts.

BRIEF DESCRIPTION OF THE DRAWING

The invention will now be described more closely with reference to the appended drawing.

DETAILED DESCRIPTION OF THE DRAWING

Figure 1:
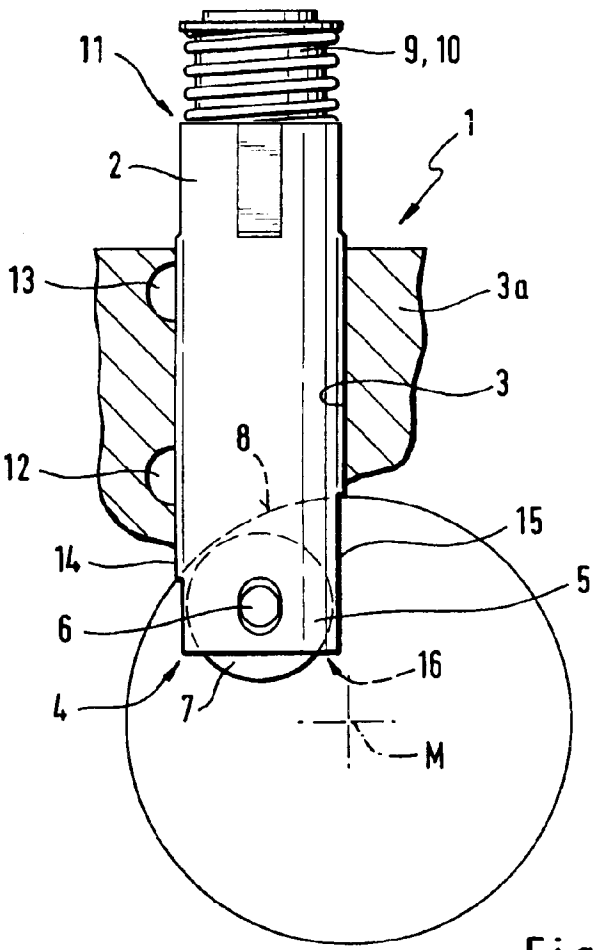
FIG. 1 is a schematic representation of a first embodiment of a tappet of the invention extending in a guide bore of an internal combustion engine.

The invention will now be described with reference to FIGS. 1 and 2. These two figures disclose a tappet 1 configured as a roller tappet. This comprises a housing 2 which extends with its outer peripheral surface in a guide bore 3 of an internal combustion engine 3*a* for axial displacement therein. An inner element 9 installed in the housing 2 for axial displacement relative thereto projects with its head 10 beyond a front end 11 of the housing 2 and possesses, in this region, a support for a tappet push rod, not illustrated.

The tappet 1 is arranged safe against rotation in the reception bore 3. A hydraulic lash adjusting device, not shown, of a type known, per se, extends in the interior of the tappet 1. Arranged additionally in the tappet is a coupling means for optionally coupling and uncoupling the inner element 9 from the housing 2 for achieving a maximum lift or a lift cutoff. For further information, reference may be made to DE 100 02 287 A1.

At a front end 4 opposite from the aforesaid front end 11, the housing 2 comprises two diametrically opposite cheek-like extensions 5. In the side view of the tappet 1 shown in the figures, only one of these extensions 5 can be seen. The extensions 5 are connected by an axle 6 on which a rotary roller 7 is mounted for making direct contact with a cam. These extensions 5 are left over, so to speak, as "residual parts", for example, after a cutting operation such as disk milling.

A transverse region 8 of the front end 4 connects the extensions 5 axially on the inside and has a generally cylindrical shape in the length direction of the roller 7. It can be seen in the figure that a radius center point M of the transverse region 8 of the front end 4 does not intersect the longitudinal axis of the tappet 1 but is laterally offset therefrom. It is clear to a person skilled in the art that for making the extensions 5 by evacuating the intermediate space 16, the disk milling cutter must likewise be laterally offset for obtaining the eccentric transverse region 8.

As a result of the aforesaid configuration, the housing 2 has a lengthened and a shortened side 14, 15. In contrast to the prior art, these sides 14, 15 have different lengths. According to the invention, the lengthened side 14 that results from less evacuation of material than the side 15, is arranged during installation of the tappet 1 in the reception bore 3 on that side on which the two passages 12 and 13 extend (embodiment of FIG. 1). Due to this one-sided lengthening of the housing 2 on the side 14, an adequate sealing length is available between the housing 2 and the reception bore 3 in the region of the front end 4, so that unnecessary hydraulic medium losses do not have to be feared.

Figure 2:
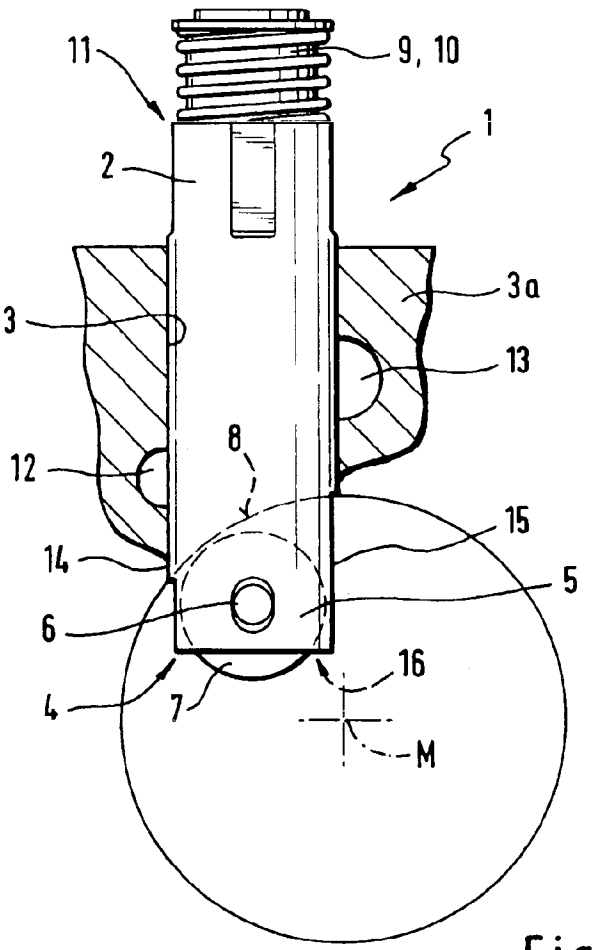
FIG. 2 is a schematic representation of a further embodiment of a tappet of the invention extending in a guide bore of an internal combustion engine.

In the case of FIG. 2, there are likewise two passages 12, 13 but these are situated in this embodiment diametrically opposite each other, the passage 13 being positioned axially higher than the passage 12. Due to its axially higher position, the passage 13 likewise has an adequate sealing length on the housing 2. It is understood that it is also possible to provide only one passage 12 which would then likewise be arranged on the lengthened side 14.

What is claimed is:

1. A tappet in a valve train of an internal combustion engine having a bottom camshaft for acting on a tappet push rod said tappet being arranged with a housing for axial displacement, but secured against rotation, in a guide bore of the internal combustion engine, said housing comprising on one front end, two cheek-like extensions that are situated diametrically opposite each other and are connected by an axle on which a rotary roller extends for making direct contact with a cam, said front end comprising a transverse region that connects the extensions axially inside and has a cylindrical shape in a length direction of the roller, an inner element being arranged in the housing for axial displacement relative to the housing, a head of the inner element forming a support for the tappet push rod in a region of a further front end of the housing, and said guide bore being intersected by one passage or by two passages for routing hydraulic medium to the tappet, wherein a radius center point of the transverse region of the one front end is situated with a lateral offset to a longitudinal axis of the tappet, one side of a periphery of the housing between the extensions is distinctly longer than an opposite side, and the one passage, or both passages is/are led to the housing at least approximately on the longer one side of the periphery wherein the tappet comprises at least one of a hydraulic lash adjuster and a coupling means for optionally uncoupling the inner element from the housing, only one passage being provided for a supply of hydraulic medium to said hydraulic lash adjuster and said coupling means.

2. A tappet in a valve train of an internal combustion engine having a bottom camshaft for acting on a tappet push rod, said tappet being arranged with a housing for axial displacement, but secured against rotation, in a guide bore of the internal combustion engine, said housing comprising on one front end, two cheek-like extensions that are situated diametrically opposite each other and are connected by an axle on which a rotary roller extends for making direct contact with a cam, said front end comprising a transverse region that connects the extensions axially inside and has a cylindrical shape in a length direction of the roller, an inner element being arranged in the housing for axial displacement relative to the housing, a head of the inner element forming a support for the tappet push rod in a region of a further front end of the housing, and said guide bore being intersected by one passage or by two passages for routing hydraulic medium to the tapped, wherein a radius center point of the transverse region of the one front end is situated with a lateral offset to a longitudinal axis of the tappet, one side of a periphery of the housing between the extensions is distinctly longer than an opposite side, and the one passage, or both passages is/are led to the housing at least approximately on the longer one side of the periphery wherein the tappet comprises a hydraulic lash adjuster and a coupling means for optionally uncoupling the inner element from the housing, two hydraulic medium passages being provided, one of these two passages supplies hydraulic medium to the hydraulic lash adjuster, and the other of these two passages provides hydraulic medium to the coupling means.

3. A tappet, in a valve train of an internal combustion engine having a bottom camshaft for acting on a tappet push rod, said tappet being arranged with a housing for axial displacement, but secured against rotation, in a guide bore of the internal combustion engine or of a component connected to the internal combustion engine, said housing comprising on one front end, two cheek-like extensions that are situated diametrically opposite each other and are connected by an axle on which a rotary roller extends for making direct contact with a cam, said front end comprising a transverse region that connects the extensions axially inside and has a cylindrical shape in a length direction of the roller, an element being arranged in the housing for axial displacement relative to the housing, a head of the inner element forming a support for the tappet push rod in a region of a further front end of the housing, and said guide bore being intersected by a first passage and a second passage for routing hydraulic medium to the tappet, wherein a radius center point of the transverse region of the one front end is situated with a lateral offset to a longitudinal axis of the tappet, so that one side of a periphery of the housing between the extensions is distinctly larger than an opposite side, and the first passage is led to the housing at least approximately on the longer one side of the periphery and the second passage is led to the housing at least approximately on the shorter, opposite side of the periphery, said second passage being led to the housing at a larger axial distance from the one front end of the housing than the first passage wherein the tappet comprises a hydraulic lash adjuster and a coupling means for optionally uncoupling the inner element from the housing, two hydraulic medium passages being provided, one of these two passages supplies hydraulic medium to the hydraulic lash adjuster, and the other of these two passages supplies hydraulic medium to the coupling means.

4. A tappet, in a valve train of an internal combustion engine having a bottom camshaft for acting on a tappet push rod, said tappet being arranged with a housing for axial displacement, but secured against rotation, in a guide bore of the internal combustion engine, said housing comprising on one front end, two cheek-like extensions that are situated diametrically opposite each other and are connected by an axle on which a rotary roller extends for making direct contact with a cam, said front end comprising a transverse region that connects the extensions axially inside and has a cylindrical shape in a length direction of the roller, an inner element being arranged in the housing for axial displacement relative to the housing, a head of the inner element forming a support for the tappet push rod in a region of a further front end of the housing, and said guide bore being intersected by one passage or by two passages for routing hydraulic medium to the tappet, wherein a radius center point of the transverse region of the one front end is situated with a lateral offset to a longitudinal axis of the tappet, one side of a periphery of the housing between the extensions is distinctly longer than an opposite side, and the one passage, or both passages is/are led to the housing at least approximately on the longer one side of the periphery wherein the tappet comprises a coupling means for optionally uncoupling the inner element from the housing, two hydraulic medium passages being provided, one of these two passages serves to displace the coupling means into an uncoupling position, and the other of these two passages serves to displace the coupling means into a coupling position.

5. A tappet in a valve train of an internal combustion engine having a bottom camshaft for acting on a tappet push rod, said tappet being arranged with a housing for axial displacement, but secured against rotation, in a guide bore of the internal combustion engine or of a component connected to the internal combustion engine, said housing comprising on one front end, two cheek-like extensions that are situated diametrically opposite each other and are connected by an axle on which a rotary roller extends for making direct contact with a cam, said front end comprising a transverse region that connects the extensions axially inside and has a cylindrical shape in a length direction of the roller, an element being arranged in the housing for axial displacement relative to the housing, a head of the inner element forming a support for the tappet push rod in a region of a further front end of the housing, and said guide bore being intersected by a first passage and a second passage for routing hydraulic medium to the tappet, wherein a radius center point of the transverse region of the one front end is situated with a lateral offset to a longitudinal axis of the tappet, so that one side of a periphery of the housing between the extensions is distinctly larger than an opposite side, and the first passage is led to the housing at least approximately on the longer one side of the periphery and the second passage is led to the housing at least approximately on the shorter, opposite side of the periphery, said second passage being led to the housing at a larger axial distance from the one front end of the housing than the first passage wherein the tappet comprises a coupling means for optionally uncoupling the inner element from the housing, two hydraulic medium passages being provided, one of these two passages serves to displace the coupling means into an uncoupling position, and the other of these two passages serves to displace the coupling means into a coupling position.

* * * * *